US008443913B2

(12) United States Patent
Nagasaka et al.

(10) Patent No.: US 8,443,913 B2
(45) Date of Patent: May 21, 2013

(54) HOOK FOR ELECTRIC POWER TOOL AND RECHARGEABLE ELECTRIC POWER TOOL EQUIPPED WITH THE HOOK

(75) Inventors: Hidenori Nagasaka, Anjo (JP); Ryunosuke Kumagai, Anjo (JP); Shinsuke Okuda, Anjo (JP)

(73) Assignee: Makita Corporation, Anjo (JP)

( * ) Notice: Subject to any disclaimer, the term of this patent is extended or adjusted under 35 U.S.C. 154(b) by 288 days.

(21) Appl. No.: 12/911,207

(22) Filed: Oct. 25, 2010

(65) Prior Publication Data

US 2011/0108300 A1 May 12, 2011

(30) Foreign Application Priority Data

Nov. 10, 2009 (JP) ..... 2009-257369

(51) Int. Cl.
*B25F 5/00* (2006.01)

(52) U.S. Cl.
USPC ..... 173/171; 173/217

(58) Field of Classification Search
USPC ..... 173/217, 171
See application file for complete search history.

(56) References Cited

U.S. PATENT DOCUMENTS

| | | | | | |
|---|---|---|---|---|---|
| 3,809,349 | A * | 5/1974 | Baedke | 248/51 |
| 4,214,688 | A * | 7/1980 | Griffin, Jr. | 224/197 |
| 4,530,500 | A * | 7/1985 | Kaymen | 473/406 |
| 4,536,694 | A * | 8/1985 | McCarty et al. | 320/111 |
| 4,736,877 | A * | 4/1988 | Clark | 224/666 |
| 5,025,966 | A * | 6/1991 | Potter | 224/183 |
| 5,195,667 | A * | 3/1993 | Gallant | 224/197 |
| 5,232,136 | A * | 8/1993 | Unger | 224/247 |
| 5,441,185 | A * | 8/1995 | Dragos | 224/666 |
| 5,501,382 | A * | 3/1996 | Webb | 224/673 |
| 5,511,705 | A * | 4/1996 | Dreszer | 224/666 |
| 5,605,263 | A * | 2/1997 | Pursley et al. | 224/248 |
| 5,810,232 | A * | 9/1998 | Meurer et al. | 224/677 |
| 6,193,125 | B1 * | 2/2001 | Grover | 224/575 |
| 6,325,577 | B1 * | 12/2001 | Anderson | 408/241 R |
| 6,428,925 | B1 * | 8/2002 | Takeno et al. | 429/163 |
| 6,536,536 | B1 * | 3/2003 | Gass et al. | 173/2 |
| 6,679,406 | B2 * | 1/2004 | Sakai et al. | 224/269 |
| 2002/0122707 | A1 * | 9/2002 | Sakai et al. | 408/241 R |
| 2003/0082439 | A1 * | 5/2003 | Sakakibara | 429/120 |
| 2003/0159843 | A1 * | 8/2003 | Sakai et al. | 173/216 |
| 2004/0065709 | A1 * | 4/2004 | Dillenberger | 224/682 |
| 2006/0048959 | A1 * | 3/2006 | Sakai et al. | 173/216 |
| 2009/0014194 | A1 * | 1/2009 | Sakai et al. | 173/93 |

FOREIGN PATENT DOCUMENTS

| | | |
|---|---|---|
| JP | A-2008-62345 | 3/2008 |
| JP | A-2009-78322 | 4/2009 |

* cited by examiner

*Primary Examiner* — Brian D Nash
(74) *Attorney, Agent, or Firm* — Oliff & Berridge, PLC

(57) ABSTRACT

A hook for an electric power tool is engageable with a carabiner comprising a hook end portion, and a gate member capable of opening the hook end portion. The hook includes: a base portion attached to a housing of a rechargeable electric power tool; an engagement portion positioned outside the base portion and having a first through-hole; a folded-back portion connecting the base portion and the engagement portion and having a second through-hole; and an outer abutment portion formed between the first and second through-holes and configured to cause the gate member to be bent inwardly when the gate member is pressed against the outer abutment portion. The outer abutment portion is engaged with the carabiner by inserting the hook end portion into the first and second through-holes, while the gate member is pressed against the outer abutment portion to open the hook end portion.

21 Claims, 10 Drawing Sheets

HOOK FOR ELECTRIC POWER TOOL AND RECHARGEABLE ELECTRIC POWER TOOL EQUIPPED WITH THE HOOK

This application claims the entire benefit of Japanese Patent Application Number 2009-257369 filed on Nov. 10, 2009, the entirety of which is incorporated by reference.

BACKGROUND OF THE INVENTION

1. Field of the Invention

The present invention relates to a hook for an electric power tool engageable with a carabiner comprising a hook end portion, and a gate member capable of opening the hook end portion when it is pressed and bent inwardly, and the hook comprises a base portion attached to a housing of a rechargeable electric power tool, and an engagement portion connected to the base portion through a folded-back portion and positioned outside the base portion. The present invention also relates to a rechargeable electric power tool equipped with this hook.

2. Description of Related Art

As disclosed in Japanese Laid-open Patent Publication Nos. 2008-62345 and 2009-78322, a hook is attached to a bottom side portion of a housing of a rechargeable electric power tool, such as an impact driver, to which a rechargeable battery is attached. The rechargeable electric power tool is then hanged from a belt or the like of a worker by the engagement between the hook and the belt.

In general, the hook for a rechargeable electric power tool is engaged with a carabiner attached to the belt of the worker. When the hook is engaged with the carabiner, the connection between the hook and the carabiner may be performed in a one-handed operation of the worker. However, when the hook is disengaged from the carabiner, it is necessary for the worker to keep the gate member of the carabiner remain bent inwardly using one hand and to remove the hook from the carabiner by manipulating the hook using the other hand, so that two-handed operation is required for the worker. This leads to a deterioration in usability of the hook for a rechargeable electric power tool.

In view of the above drawback of the conventional hook, the present invention seeks to provide a hook for an electric power tool, which is easily operable by one hand upon engagement with and disengagement from the carabiner and therefore excels in the usability. The present invention also seeks to provide a rechargeable electric power tool equipped with this hook.

SUMMARY OF THE INVENTION

In accordance with a first aspect of the present invention, as embodied and described herein, there is provided a hook for an electric power tool engageable with a carabiner which comprises a hook end portion, and a gate member capable of opening the hook end portion when it is pressed and bent inwardly, the hook comprising: a base portion attached to a housing of a rechargeable electric power tool; an engagement portion positioned outside the base portion and having a first through-hole into which the hook end portion is inserted; a folded-back portion connecting the base portion and the engagement portion and having a second through-hole into which the hook end portion is inserted; an outer abutment portion formed between the first through-hole and the second through-hole and configured to cause the gate member to be bent inwardly when the gate member is pressed against the outer abutment portion; and an inner abutment portion formed between the base portion and the second through-hole and configured to cause the gate member to be bent inwardly when the gate member is pressed against the inner abutment portion, wherein the outer abutment portion is engaged with the carabiner by inserting the hook end portion into the first through-hole and the second through-hole, while the gate member is pressed against the outer abutment portion to open the hook end portion; and wherein the outer abutment portion is disengaged from the carabiner by pulling out the hook end portion from the first through-hole, while the gate member is pressed against the inner abutment portion and moved away from the second through-hole to open the hook end portion.

According to one specific embodiment of the aforementioned hook, the base portion may be attached to an attachment portion for a battery pack formed on the housing in such a manner that the base portion is positioned parallel to a side surface of the battery pack in a direction where the base portion protrudes from the attachment portion.

In accordance with a second aspect of the present invention, there is provided a rechargeable electric power tool comprising: a housing; and a battery pack as a power source configured to be detachably mounted to the housing, wherein the hook for the electric power tool according the first aspect of the present invention is attached to the housing.

According to one specific embodiment of the aforementioned rechargeable electric power tool, the base portion may be attached to an attachment portion for a battery pack formed on the housing in such a manner that the base portion is positioned parallel to a side surface of the battery pack in a direction where the base portion protrudes from the attachment portion.

With these configurations of the hook for an electric power tool according to the first aspect of the present invention and the rechargeable electric power tool according to the second aspect of the present invention, as the outer abutment portion becomes engageable with the carabiner, the worker is able to bring the gate member into contact with the outer abutment portion by one hand to open the hook end portion, so that the opened hook end portion is guided into the first through-hole adjacent to the outer abutment portion and also into the second through-hole. Therefore, the worker can easily, by one hand, engage the outer abutment portion of the hook with the carabiner.

In addition, the worker is able to bring the gate member into contact with the inner abutment portion to open the hook end portion by one hand, so that the gate member is distanced away from the hook end portion. In other word, the gate member is away from the second through-hole, and thereafter, the hook end portion is guided into the first through-hole and pulls out the hook end portion from the first through-hole, so that the outer abutment portion can be disengaged from the carabiner. Accordingly, the worker can easily disengage the outer abutment portion from the carabiner by one hand, and a hook for an electric power tool would have excellent usability.

With these configurations of the hook for an electric power tool according to the one specific embodiment and the rechargeable electric power tool according to the one specific embodiment, when the outer abutment portion is engaged with the carabiner, the attachment portion for the battery pack can be positioned parallel to the base portion that is positioned outside the carabiner. Therefore, the attachment portion and the battery pack do not interfere with the carabiner, and the worker can engage the rechargeable electric power tool with the carabiner through the base portion in a good manipulating condition. Further, when the worker disengages the outer abutment portion from the carabiner, the gate member can be bent inwardly using the battery pack in addition to the inner abutment portion.

BRIEF DESCRIPTION OF THE DRAWINGS

The above aspect, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENT

Figure 1:
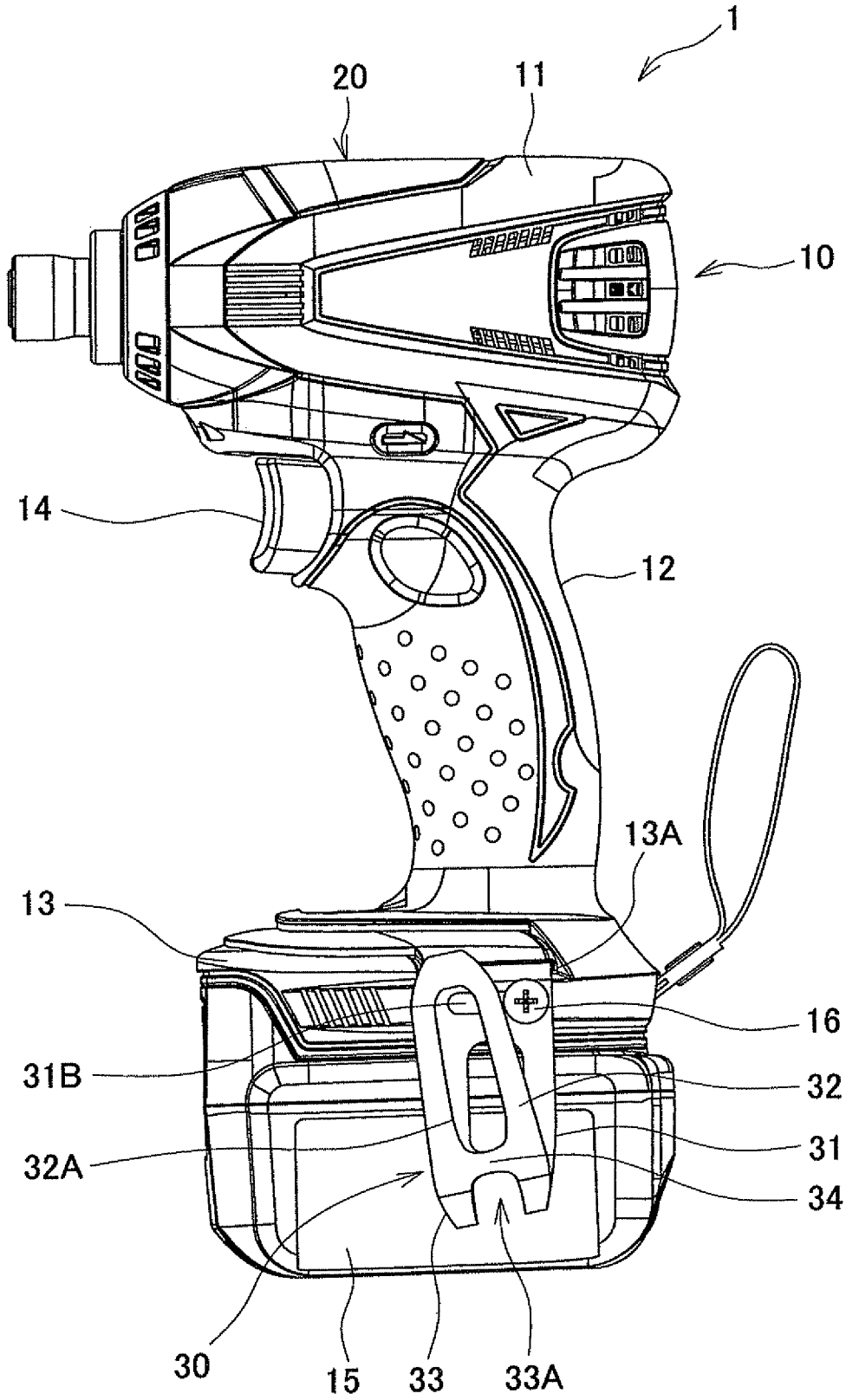
FIG. 1 is a side view of an impact driver, to which a hook for an electric power tool according to one embodiment of the present invention is attached.

With reference to FIGS. 1 to 10, one exemplary embodiment of the present invention will be described. As seen in FIGS. 1 and 2, an impact driver 1 includes a housing 10, a hammer casing 20, and a hook 30 for an electric power tool.

The housing 10 is assembled from right and left housing halves 10A, 10B (see FIG. 2B) which are made of resin, and includes a body portion 11, a handle portion 12, and a battery pack attachment portion 13. The body portion 11 has a cylindrical shape and extends in a front-back direction of the impact driver 1 (i.e., left-to-right direction of FIG. 1). A motor (not shown) is disposed in the body portion 11.

As seen in FIG. 1, the handle portion 12 extends from the body portion 11 in such a manner that the impact driver 1 has a substantially T-shaped configuration as viewed from side. A switch (not shown) with a trigger 14 is disposed inside the handle portion 12. The battery pack attachment portion 13 is positioned at a lower part of the handle portion 12, and a battery pack 15 is detachably mounted to the battery pack attachment portion 13. The battery pack 15 is a rechargeable power source and supplies electricity to the motor. The impact driver 1 is an example of a rechargeable electric power tool according to the present invention.

The hammer casing 20 is made of resin and assembled with a front part of the body portion 11 (i.e., left-hand side of FIG. 1). An impact mechanism (not shown) is disposed inside the hammer casing 20. The impact mechanism converts a rotation of the motor into a rotary impact force and then transmits this rotary impact force to a bit (not shown).

Figure 2A:
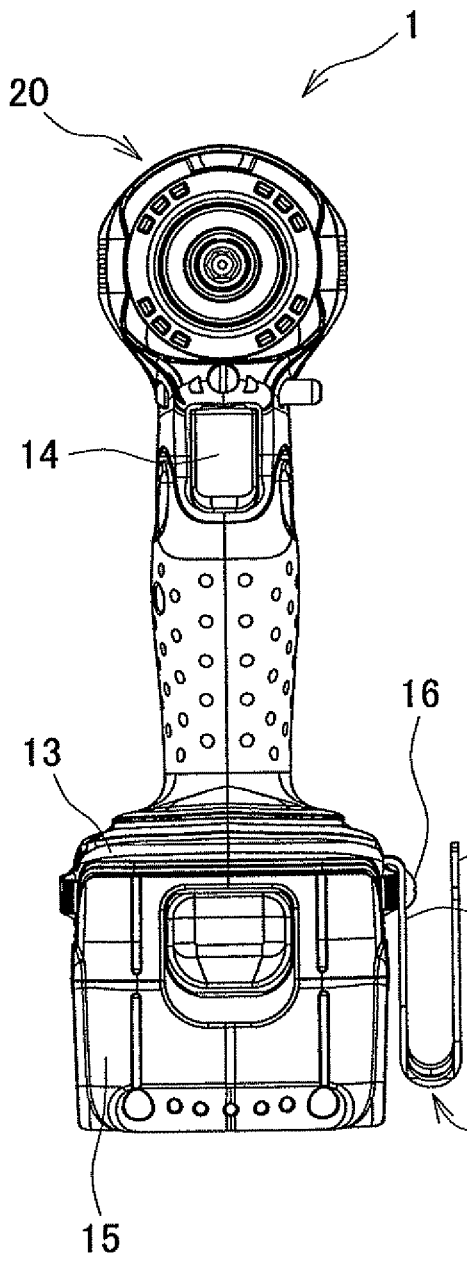
FIG. 2A is a front view of the impact driver.
Figure 2B:
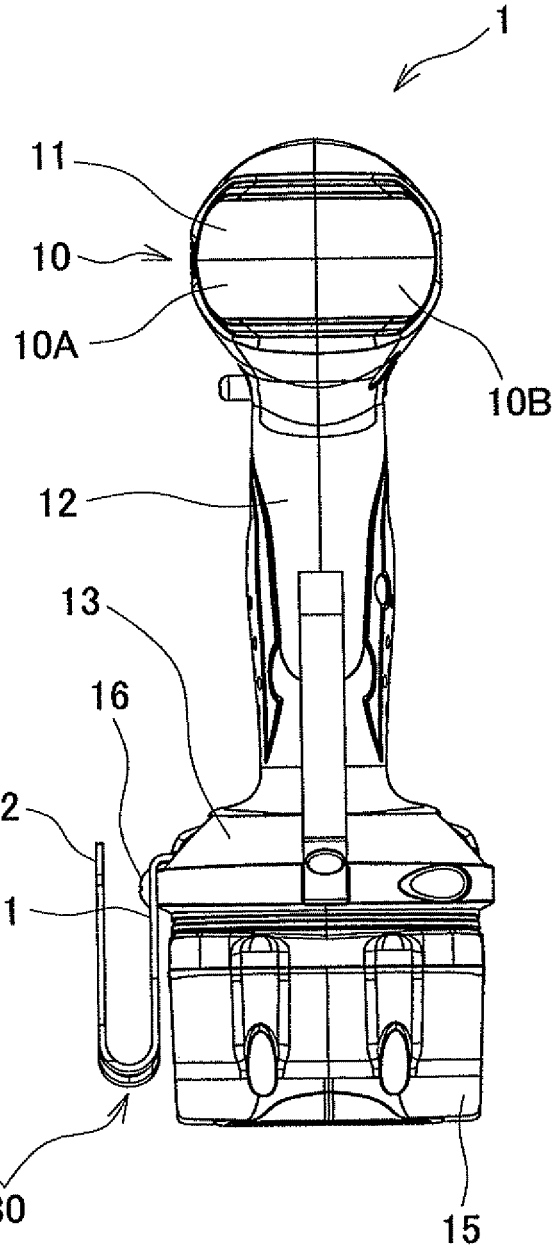
FIG. 2B is a rear view of the impact driver.

As best seen in FIG. 2A, the hook 30 for an electric power tool is mounted to the impact driver 1 using a screw 16 at a right side surface of the battery pack attachment portion 13 when viewed from the front surface of the impact driver 1. With reference to FIGS. 2A and 2B, the hook 30 is formed by bending a metal plate into a substantially U-shaped configuration as viewed from the front side and the rear side of the impact driver 1. As described later, the hook 30 is engageable with a carabiner 40 that is attached to a belt of a worker, so that the impact driver 1 is hanged from the belt.

Figure 3:
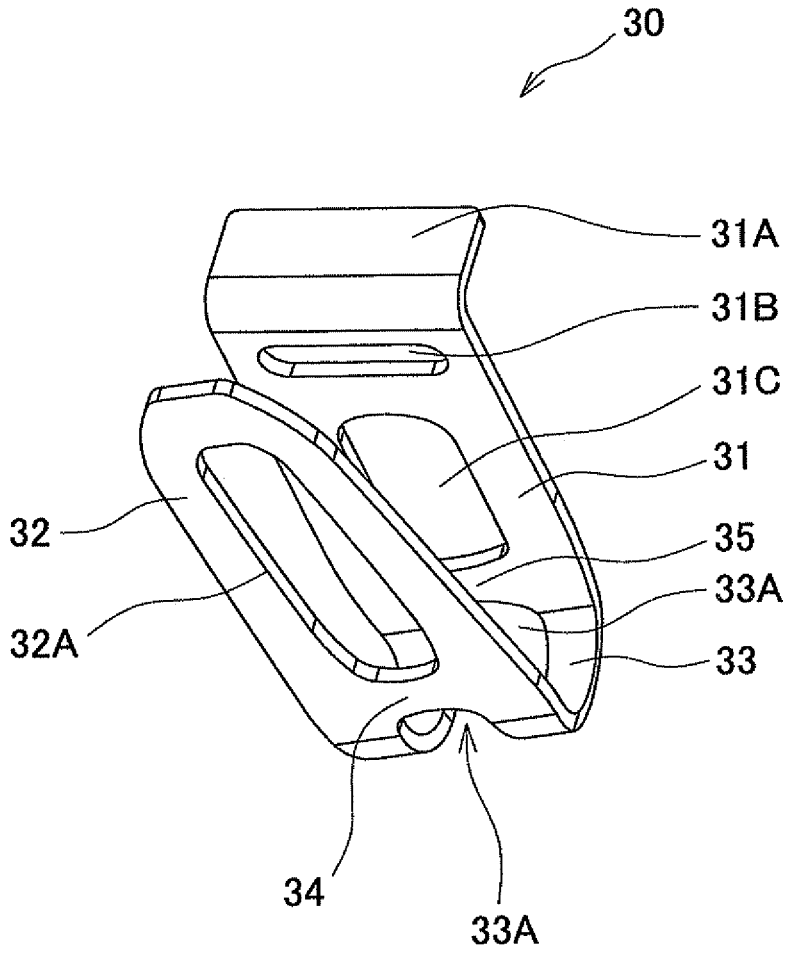
FIG. 3 is a perspective view of the hook.

As seen in FIGS. 1 to 3, the hook 30 includes a base portion 31, an engagement portion 32, a folded-back portion 33, an outer abutment portion 34, and an inner abutment portion 35. As described above, the hook 30 is shaped substantially like a letter U having two leg portions, and the base portion 31 forms one leg portion whereas the engagement portion 32 forms the other leg portion.

The base portion 31 is configured to be attached to the battery pack attachment portion 13, and has a protruding strip 31A and an oblong hole 31B. The protruding strip 31A is formed by bending an end edge portion of the base portion 31 at right angles in a direction away from the engagement portion 32. The protruding strip 31A is fitted into a slit-hole 13A (see FIG. 1) that is formed laterally in the right side surface of the battery pack attachment portion 13. When the protruding strip 31A is fitted into the slit-hole 13A, the base portion 31 is engaged with the battery pack attachment portion 13 to thereby provisionally positioning the base portion 31 parallel to the side surface of the battery pack 15.

The oblong hole 31B is formed in the base portion 31 close to the end edge portion. The oblong hole 3113 extends laterally of the base portion 31 (i.e., in the right-left direction of FIG. 3). When the hook 30 is attached to the battery pack attachment portion 13, as described above, the base portion 31 is provisionally positioned parallel to the side surface of the battery pack 15. Thereafter, the screw 16 is inserted through the oblong hole 31B and threadedly fixed to the battery pack attachment portion 13. Accordingly, as seen in FIG. 2, the base portion 31 is fixed to the battery pack attachment portion 13 so as to be parallel to the side surface of the battery pack 15.

As seen in FIG. 3, the engagement portion 32 forms the other leg portion and is positioned opposite to the base portion 31 which forms the one leg portion. As best seen in FIGS. 2A and 2B, when the base portion 31 is threadedly fixed to the battery pack attachment portion 13 by the screw 16, the engagement portion 32 is positioned outside the base portion 31. As seen in FIG. 3, a first through-hole 32A having an elongated shape is formed in the engagement portion 32 and extends in the longitudinal direction of the engagement portion 32. When a hook end portion 42A of the carabiner 40 is inserted into the first through-hole 32A by a worker, the hook 30 is engaged with the carabiner 40.

The folded-back portion 33 is positioned between the base portion 31 and the engagement portion 32, and forms a folded-back part of the hook 30 from the distal end of the base portion 31 toward the engagement portion 32. The engagement portion 32 is therefore joined to the base portion 31 through the folded-back portion 33. As seen in FIGS. 1 and 3, a second through-hole 33A is formed in the folded-back portion 33. Accordingly, the two leg portions of the substantially U-shaped hook 30 are in communication with the outer surface of the folded-back portion 33. The carabiner 40 is engaged with the hook 30, after the hook end portion 42A of the carabiner 40 is inserted into the first through-hole 32A and further into the second through-hole 33A by the worker.

As best seen in FIGS. 1 and 3, the outer abutment portion 34 is provided and formed between the first through-hole 32A and the second through-hole 33A. When the gate member 41 of the carabiner 40 is brought into pressingly contact with the outer abutment portion 34 by the worker, the gate member 41 is bent inward and the hook 30 is engaged with the carabiner 40.

As seen in FIG. 3, the inner abutment portion 35 is provided and formed between a third through-hole 31C of the base portion 31 and the second through-hole 33A. As described later, when the gate member 41 is brought into pressingly contact with the inner abutment portion 35 by the worker, the gate member 41 is bent inward and the hook 30 disengaged from the carabiner 40. The carabiner 40 shown in FIGS. 4 to 10 is attached to the belt (not shown) of the worker. The carabiner 40 is shaped substantially like an oval loop, and includes a gate member 41 and a hook 42.

Figure 4:
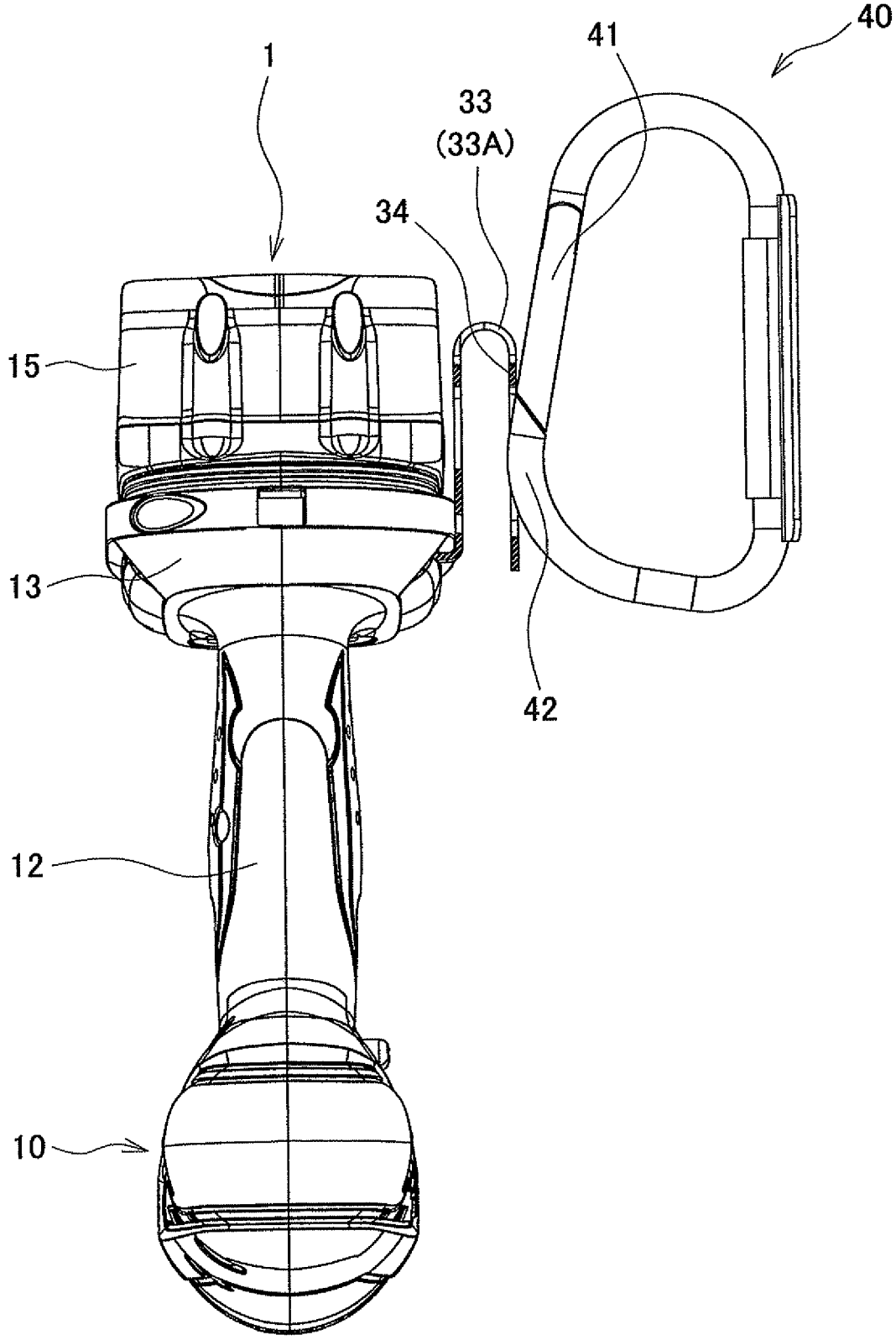
FIG. 4 shows a state in which an outer abutment portion of the hook is moved closely to a gate member of a carabiner.

As best shown in FIG. 4, when the gate member 41 is in a normal state in which it is not pressed inward, a spring provided inside the fulcrum urges the gate member 41 so that the gate member 41 forms a part of the oval loop. Meanwhile, as best seen in FIG. 5, the gate member 41 is pressed inward, the gate member 41 is caused to be rotated around the fulcrum and bent inward toward the inner region of the oval loop.

Figure 5:
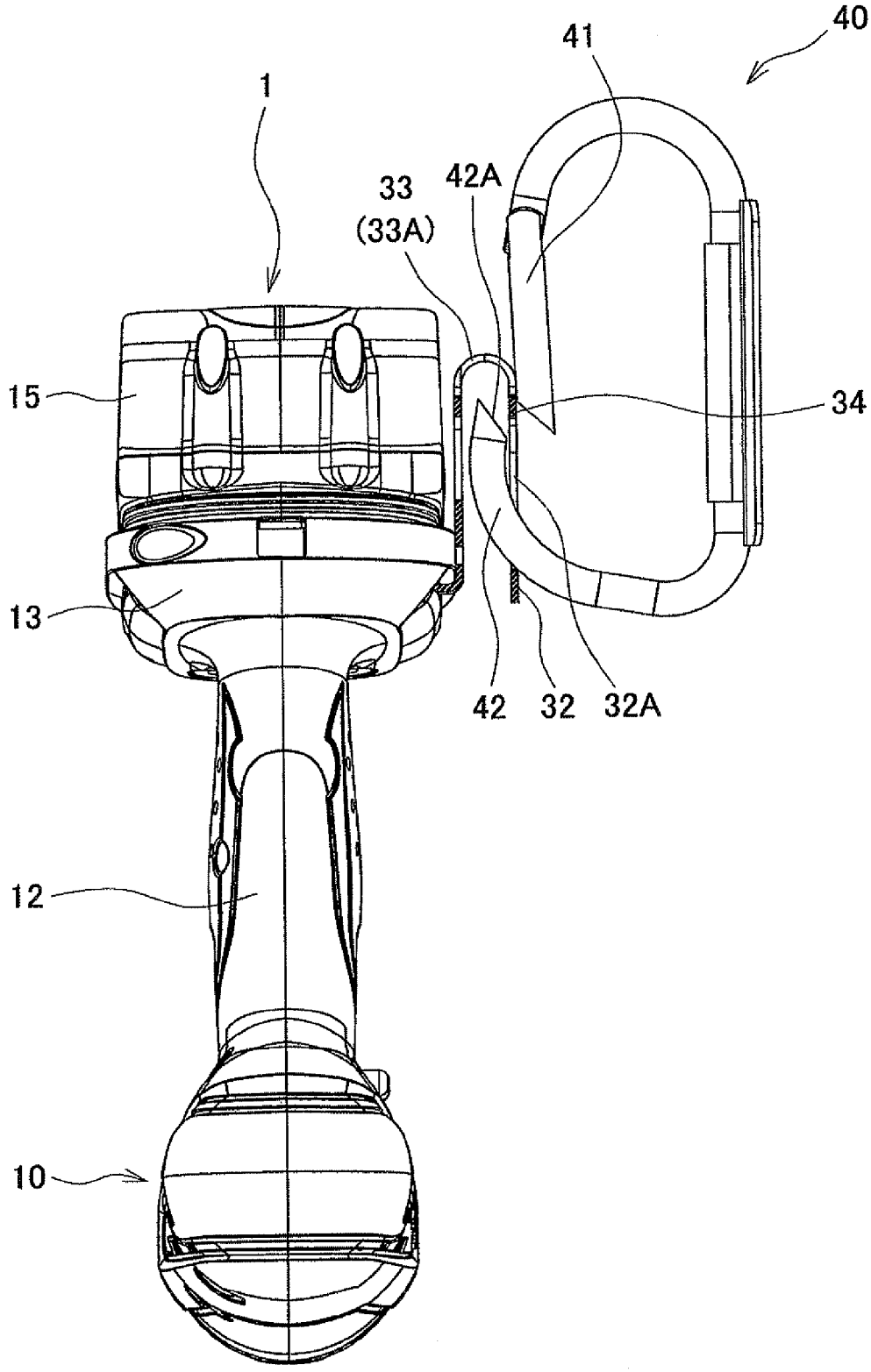
FIG. 5 shows a state in which a hook end portion of the carabiner is inserted into a first through-hole of the hook.

As seen in FIG. 5, the hook 42 is substantially like an oval shape, part of which is open through the gate member 41. In the normal state, the hook end portion 42A forms the oval shape together with the gate member 41 and closes the loop. On the other hand, when the gate member 41 is caused to be bent inward toward the inner region of the oval loop, as shown in FIG. 5, the hook end portion 42A is released.

Next, with reference to FIGS. 4 to 7, the operation of the worker will be described when he engages the hook 30 with the carabiner 40. As best seen in FIG. 4, the worker positions the impact driver 1 such that the housing 10 faces downward and the battery pack 15 faces upward. Thereafter, the worker holds the handle portion 12 by one hand and moves the outer abutment portion 34 closer to the lower end side of the gate member 41 while the rear surface of the impact driver 1 faces the worker.

When the worker brings the outer abutment portion 34 into pressingly contact with the lower end side of the gate member 41 of the carabiner 40 with holding the handle portion 12 by one hand, the gate member 41 is bent inward toward the inner region of the oval loop, and the hook end portion 42A is released as seen in FIG. 5. As a result, the insertion of the hook end portion 42 into the first through-hole 32A positioned below and adjacent to the outer abutment portion 34 is easily made. When the insertion is completed, the hook end portion 42A is between the pair of leg portions of the substantially U-shaped configuration as shown in FIG. 5.

Thereafter, when the engagement portion 32 is slid along the gate member 41 toward the lower side of the gate member 41 by the worker, the folded-back portion 33 (second through-hole 33A) positioned between and above the two leg portions is moved toward the hook end portion 42A.

Figure 6:
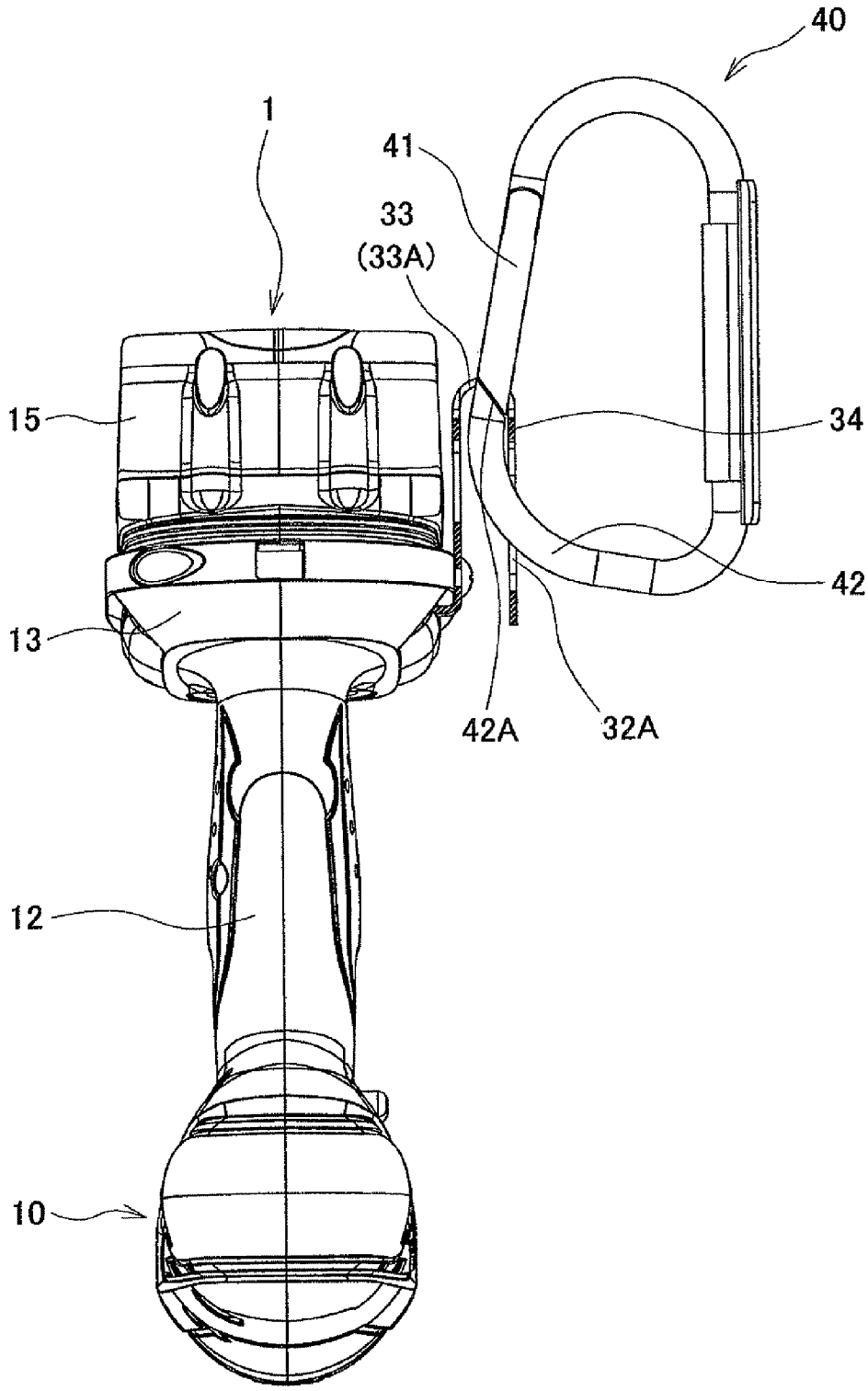
FIG. 6 shows a state in which the hook end portion and the gate member are joined to close the carabiner.

When the folded-back portion 33 (second through-hole 33A) further toward the hook end portion 42A and the second through-hole 33A almost reaches the hook end portion 42A, the outer abutment portion 34 moves distanced away from the gate member 41. Therefore, the outer abutment portion 34 is not urged against the gate member 41, the gate member 41 returns to the original position, i.e., a previous state where the gate member 41 is not pressed, by the urging force of the spring. Accordingly, as best seen in FIG. 6, the gate member 41 enters the second through-hole 33A, and joined with the hook end portion 42A near the second through-hole 33A, so that the substantially closed oval loop is formed.

Figure 7:
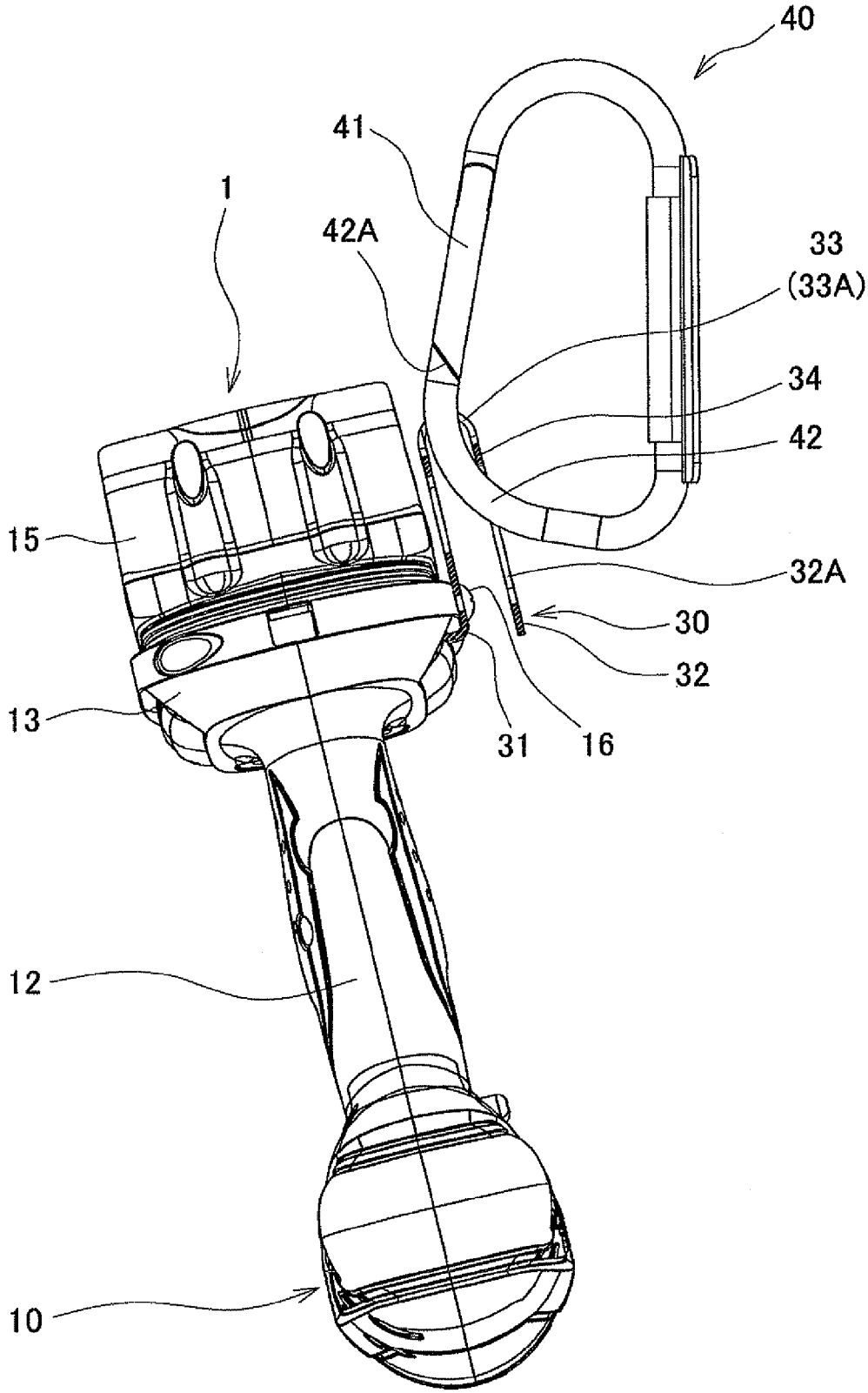
FIG. 7 shows a state in which the outer abutment portion of the hook is engaged with the carabiner.

Further, when the hook 30 is continuously slid toward the lower side of the carabiner 40 along the substantially oval loop of the carabiner 40 by the worker who with the handle portion 12, the sliding movement of the hook 30 is inhibited by the outer abutment portion 34. As shown in FIG. 7, while the hook end portion 42A is being inserted into the first through-hole 32A and the second through-hole 33A, the outer abutment portion 34 is engaged with the hook 42 of the carabiner 40. Accordingly, the impact driver 1 is hanged from the carabiner 40 using the hook 30. In this state, the base portion 31 is positioned outside the carabiner 40. Further, the battery pack attachment portion 13 and the battery pack 15 are positioned outside the base portion 31, as shown in FIG. 7. That is, the base portion 31 is interposed between the battery pack attachment portion 13 and the carabiner 40, which inserts that the battery pack attachment portion 13 and the battery pack 15 do not interfere with the carabiner 40.

Figure 8:
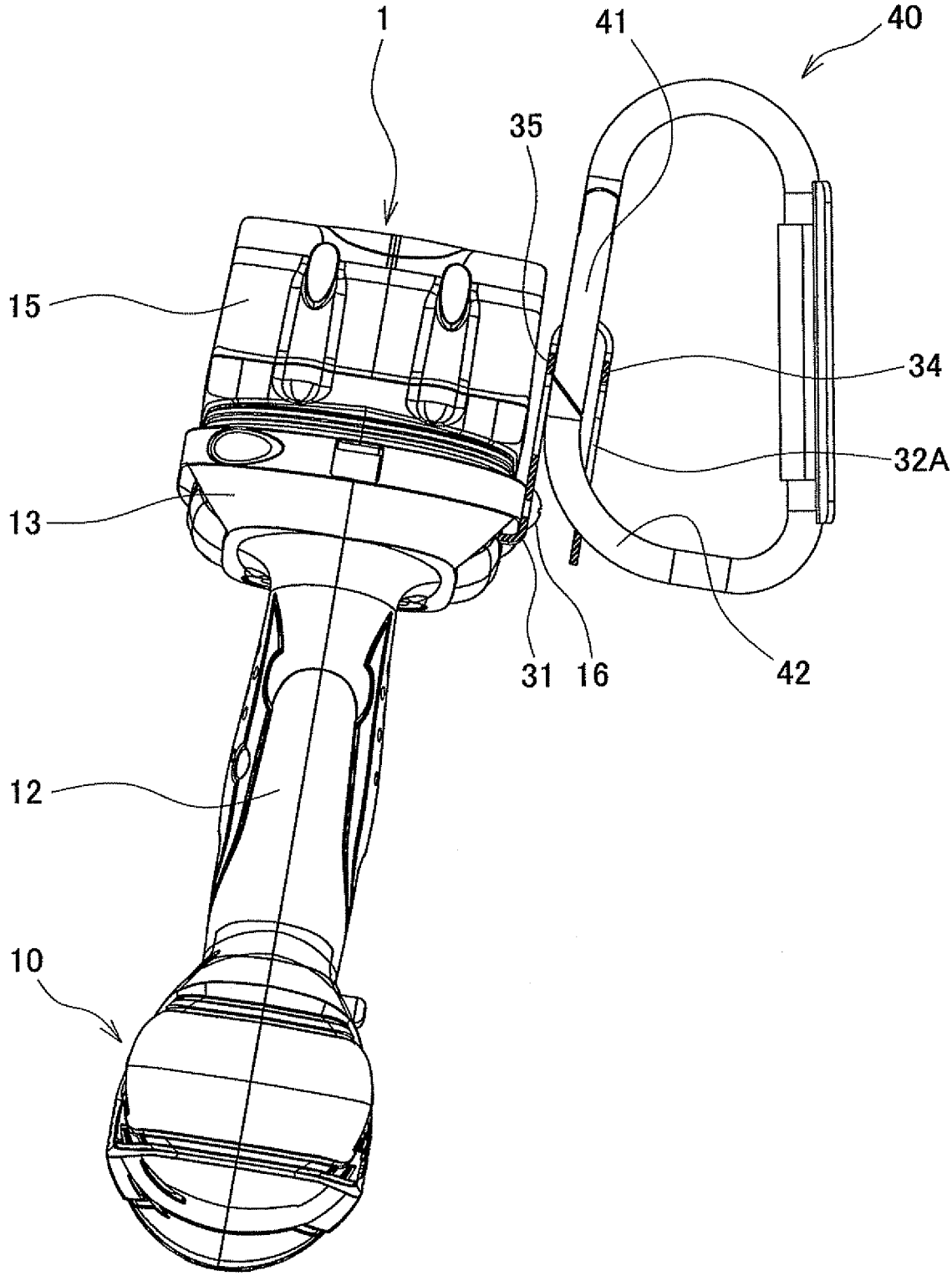
FIG. 8 shows a state in which an inner abutment portion of the hook is brought into contact with the gate member of the carabiner.
Figure 9:
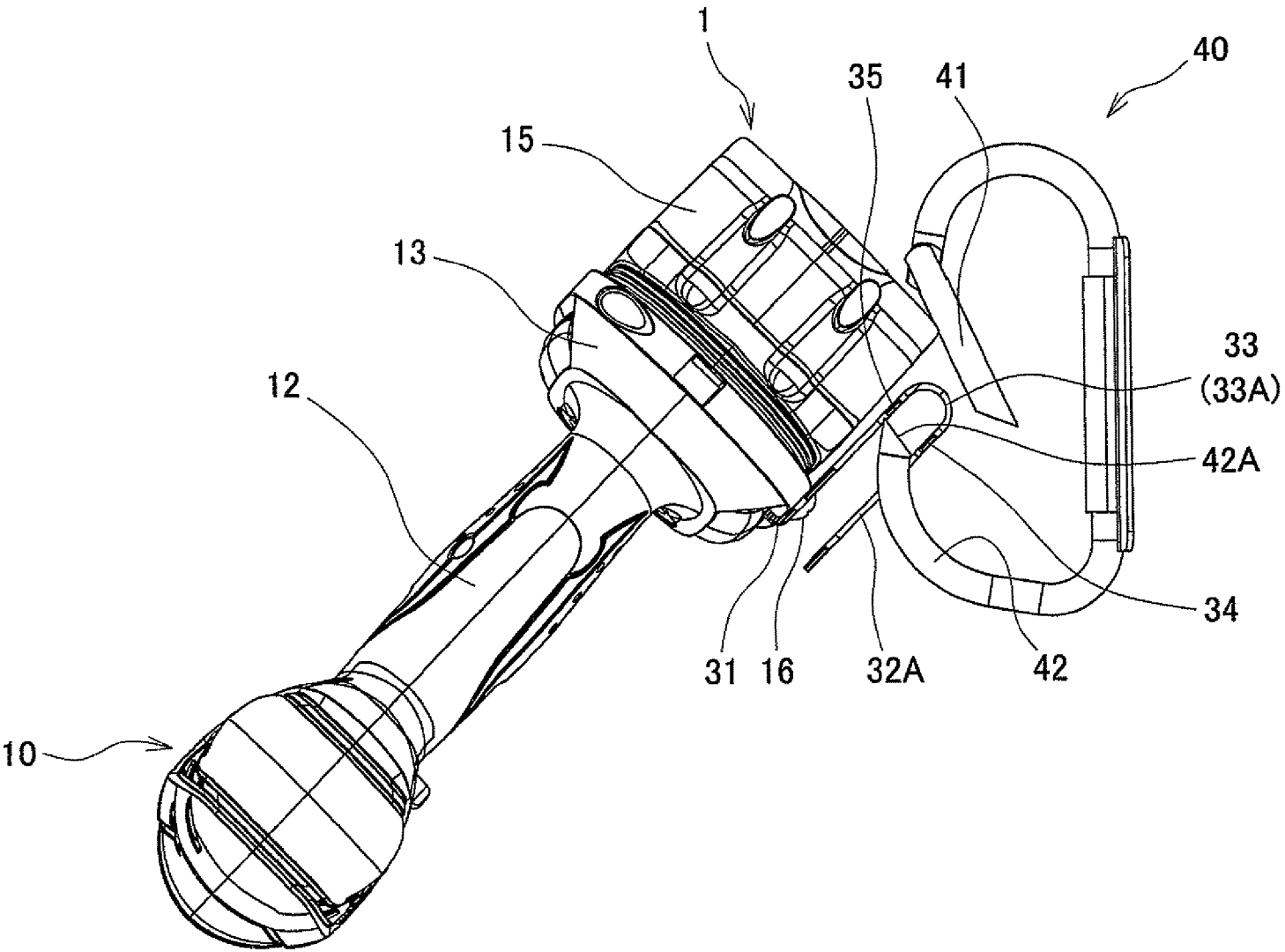
FIG. 9 shows a state in which the gate member is pulled out from a second through-hole of the hook.
Figure 10:
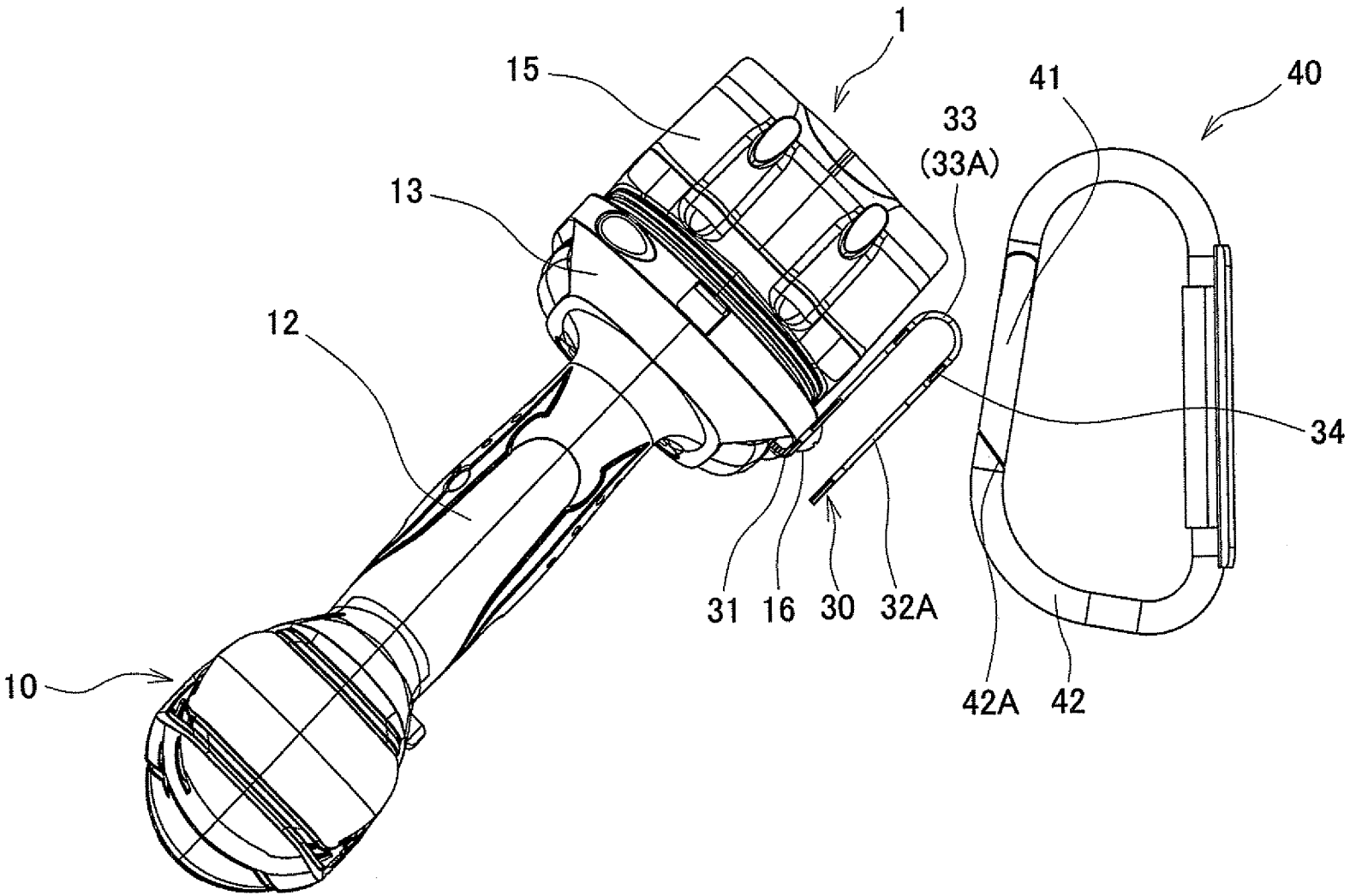
FIG. 10 shows a state in which the hook is disengaged from the carabiner.

With reference to FIGS. 8 to 10, the operation of the worker will be described when he disengages the hook 30 from the carabiner 40. As best seen in FIG. 8, the worker brings the inner abutment portion 35 into contact with the lower end side of the gate member 41. Then, the worker holds the handle portion 12 by one hand and slides the base portion 31 toward the upper side of the carabiner 40 along the substantially oval loop of the carabiner 40.

When the inner abutment portion 35 is brought into pressingly contact with the lower end side of the gate member 41 of the carabiner 40 by the worker with holding the handle portion 12 by one hand, which causes the gate member 41 is bent inward toward the inner region of the oval loop, and the hook end portion 42A is released as seen in FIG. 9. According to this embodiment, since a corner portion of the battery pack 15 is positioned more inward and higher than the inner abutment portion 35, the gate member 41 is bent inwardly to a large extent using this corner portion. Consequently, the worker is able to pull out the gate member 41 from the second through-hole 33A easily. Thereafter, when the impact driver 1 is slid toward the upper side of the carabiner 40, by the worker, along the gate member 41 that is bent inward to open the hook end portion 42A, the first through-hole 32A can be pulled out from the hook 42 without difficulty. As a result, as seen in FIG. 10, the outer abutment portion 34 of the hook 30 is disengaged from the carabiner 40. Thereafter, by the urging force of the spring, the gate member 41 returns to the original position and closes the hook end portion 42A.

ADVANTAGEOUS EFFECTS

According to the hook 30 for an electric power tool and the impact driver 1 equipped with the hook 30 in the exemplary embodiment of the present invention, the outer abutment portion 34 is provided between the first through-hole 32A and the second through-hole 33A, and as seen in FIG. 7, the outer abutment portion 34 is engaged with the hook 42 by inserting the hook end portion 42A into the first through-hole 32A and the second through-hole 33A, while the gate member 41 is pressed against the outer abutment portion 34 to open the hook end portion 42A. Therefore, the worker can easily insert the hook end portion 42A into the first through-hole 32A that is positioned below and adjacent to the outer abutment portion 34 by pressing the lower end side of the gate member 41 against the outer abutment portion 34 while the worker holds the handle portion 12 by one hand. Thereafter, the worker slides the hook 30 by one hand toward the lower side of the carabiner 40, so that the outer abutment portion 34 is brought into engagement with the hook 42 of the carabiner 40 with the hook end portion 42A being inserted into the first through-hole 32A and the second through-hole 33A. Accordingly, the worker can easily, by one hand, engage the outer abutment portion 34 with the hook 42.

In addition, the inner abutment portion 35 is provided between the third through-hole 31C of the base portion 31 and the second through-hole 33A. As shown in FIG. 9, the gate member 41 can be easily pulled out from the second through-hole 33A when the worker brings the lower end side of the gate member 41 into pressingly contact with the inner abutment portion 35 to open the hook end portion 42A and thereafter slides the impact driver 1 smoothly toward the upper side of the carabiner 40 along the gate member 41 that is bent inwardly. Further, the hook end portion 42A can be easily moved from between the two leg portions of the substantially U-shaped configuration and through the first through-hole 32A, so that the outer abutment portion 32A can be disengaged from the carabiner 40 by pulling the hook end portion 42A out of the two leg portions through the first through-hole 32A. Therefore, while the worker holds the handle portion 12 by one hand, he brings the lower end side of the gate member 41 into pressingly contact with the inner abutment portion 35 and slides the impact driver 1 toward the upper side of the carabiner 40. This make is possible for the worker to easily pull out the gate member 41 by one hand from the second through-hole 33A. Thereafter, as seen in FIG. 10, the worker can disengage the outer abutment portion 34 of the hook 30 from the carabiner 40 when he holds the handle portion 12 by one hand and simply passes the hook end portion 42A through the first through-hole 32A. Accordingly, the worker can easily disengage the outer abutment portion 34 from the carabiner 40 by one hand, and a hook for an electric power tool would have excellent usability.

Further, according to this embodiment, the base portion 31 protrudes from the battery attachment portion 13 toward the lower side of the impact driver 1 and is fixed to the battery pack attachment portion 13 in a manner parallel to the side surface of the battery pack 15. Therefore, as described above and as shown in FIG. 7, the battery pack attachment portion 13 is positioned outside the carabiner 40 with the base portion 31 being interposed between them, so that the battery pack attachment portion 13 and the battery pack 15 do not interfere with the carabiner 40. Therefore, the worker can engage the impact driver 1 with the carabiner 40 through the base portion 31 in a good manipulating condition. Further, when the worker disengages the outer abutment portion 34 from the carabiner 40, as described above, the gate member 41 can be bent inwardly to a large extent using the corner portion of the battery pack 15 as shown in FIG. 9.

Although the present invention has been described with reference to the above exemplary embodiment, the present invention is not limited to the above specific embodiment and various changes and modifications may be made where necessary without departing from the scope of the appended claims. For example, in the above exemplary embodiment, the hook 30 is attached to the right side surface of the battery pack attachment portion 13. However, the hook 30 may be attached to the left side surface of the battery pack attachment portion 13.

Further, in the above exemplary embodiment, the hook 30 has been described as being attached to the impact driver 1. However, the present is not limited to this specific embodiment, and the hook 30 may be attached to another electric power tool, such as a driver other than impact drivers and a drill.

What is claimed is:

1. A hook for an electric power tool engageable with a carabiner which comprises a hook end portion, and a gate member capable of opening the hook end portion when it is pressed and bent inwardly, the hook comprising:

a base portion attached to a housing of a rechargeable electric power tool;

an engagement portion positioned outside the base portion and having a first through-hole into which the hook end portion is inserted;

a folded-back portion connecting the base portion and the engagement portion and having a second through-hole into which the hook end portion is inserted;

an outer abutment portion formed between the first through-hole and the second through-hole and configured to cause the gate member to be bent inwardly when the gate member is pressed against the outer abutment portion;

an inner abutment portion formed between the base portion and the second through-hole and configured to cause the gate member to be bent inwardly when the gate member is pressed against the inner abutment portion; and a portion of the hook that is generally U-shaped so as to include two leg portions, the base portion, forming one leg portion and the engagement portion forming the other leg portion, wherein the outer abutment portion is engaged with the carabiner by inserting the hook end portion into the first through-hole and the second through-hole, while the gate member is pressed against the outer abutment portion to open the hook end portion; and wherein the outer abutment portion is disengaged from the carabiner by pulling out the hook end portion from the first through-hole, while the gate member is pressed against the inner abutment portion and moved away from the second through-hole to open the hook end portion.

2. The hook for an electric power tool according to claim 1, wherein the base portion is attached to an attachment portion for a battery pack formed on the housing in such a manner that the base portion is positioned parallel to a side surface of the battery pack in a direction where the base portion protrudes from the attachment portion.

3. The hook for an electric power tool according to claim 2, wherein the base portion has a protruding strip to be fitted into a slit-hole formed in the attachment portion.

4. The hook for an electric power tool according to claim 2, wherein the base portion has an oblong hole extending in a transverse direction of the base portion, through which a screw is threadedly engaged with the attachment portion.

5. The hook for an electric power tool according to claim 1, wherein the first through-hole has an elongated shape and is formed in a surface of the other leg portion in a longitudinal direction.

6. The hook for an electric power tool according to claim 1, wherein the outer abutment portion is formed by an outer surface of the engagement portion positioned between the first through-hole and the second through-hole.

7. The hook for an electric power tool according to claim 1, wherein the inner abutment portion is formed by an inner surface of the base portion positioned between the base portion and the second through-hole.

8. A rechargeable electric power tool that functionally cooperates with a carabiner that includes a hook end portion and a gate member capable of opening the hook end portion when it is pressed and bent inwardly, the rechargeable electric power tool comprising:

a housing;

a battery pack as a power source configured to be detachably mounted to the housing; and a hook attached to the housing, the hook including:

a base portion attached to a housing of a rechargeable electric power tool;

an engagement portion positioned outside the base portion and having a first through-hole into which the hook end portion is inserted;

a folded-back portion connecting the base portion and the engagement portion and having a second through-hole into which the hook end portion is inserted;

an outer abutment portion formed between the first through-hole and the second through-hole and configured to cause the gate member to be bent inwardly when the gate member is pressed against the outer abutment portion;

an inner abutment portion formed between the base portion and the second through-hole and configured to cause the gate member to be bent inwardly when the gate member is pressed against the inner portion; and a portion of the hook that is generally U-shaped so as to include two leg portions, the base portion forming one leg portion and the engagement portion forming the other leg portion, wherein the outer abutment portion is engaged with the carabiner by inserting the hook end portion into the first through-hole and the second through-hole, while the gate member is pressed against the outer abutment portion to open the hook end portion; and wherein the outer abutment portion is disengaged from the carabiner by pulling out the hook end portion from the first through-hole, while the gate member is pressed against the inner abutment portion and moved away from the second through-hole to open the hook end portion.

9. The rechargeable electric power tool according to claim 8, wherein the base portion is attached to an attachment portion for a battery pack formed on the housing in such a manner that the base portion is positioned parallel to a side surface of the battery pack in a direction where the base portion protrudes from the attachment portion.

10. An electric power tool, comprising:

a body portion;

a handle portion extending downward from the body portion, the handle portion having a lower part;

a battery pack attachment portion disposed at the lower part of the handle portion, the battery pack attachment portion having a side surface;

a hook disposed on the side surface of the battery pack attachment portion, the hook including: a base portion to which a folded back portion is connected, an engagement portion connecting the folded back portion, a screw hole through which the screw is inserted, and a portion of the hook that is generally U-shaped so as to include two leg portions, the base portion forming one leg portion and the engagement portion forming the other leg portion; and a screw to connect the hook to the lower end of the handle portion, wherein one through-hole is formed in the base portion and another through-hole is formed in the engagement portion.

11. The electric power tool according to claim 10, wherein the hook includes a protruding strip connected to the base portion, and the screw hole is formed between a position where the one through-hole is formed and a position where the protruding strip is connected to the base portion.

12. The electric power tool according to claim 11, wherein the protruding strip is arranged at right angles to the base portion.

13. The electric power tool according to claim 10, wherein the battery pack is fixed at a lower part of the battery pack attachment portion in such a manner that the battery pack is on the side of the first through-hole.

14. The electric power tool according to claim 10, wherein an upper edge of the engagement portion is disposed above the screw hole.

15. The electric power tool according to claim 10, wherein the first through-hole is formed so as to face the second through-hole or the screw hole in a lateral direction.

16. An electric power tool engageable with a carabiner, the electric power tool comprising:

a body portion;

a handle portion extending downward from the body portion, the handle portion having a lower part;

a battery pack attachment portion disposed at the lower part of the handle portion, the battery pack attachment portion having a side surface;

a hook disposed on the side surface of the battery pack attachment portion, the hook including a portion that is generally U-shaped so as to include two leg portions, the base portion forming one leg portion and the engagement portion forming the other leg portion, the hook having an engagement portion in which a first through-hole is formed in such a manner that the carabiner can be inserted through the first through-hole; and a screw to connect the hook to the lower part of the handle portion.

17. The electric power tool according to claim 16, wherein the hook includes a folded back portion and a base portion, wherein the folded back portion is connected to the engagement portion, and the base portion is connected to the folded back portion in which a second through-hole is formed.

18. The electric power tool according to claim 17, wherein the hook has a screw hole through which the screw is inserted and a protruding strip which is connected to the base portion, the protruding strip being positioned at right angles to the base portion.

19. The electric power tool according to claim 16, wherein the base portion and the engagement portion are arranged in parallel.

20. The electric power tool according to claim 16, wherein the battery pack is fixed at a lower part of the battery pack attachment portion, and the battery pack is disposed on the side of the base portion.

21. An electric power tool comprising:

a body portion;

a handle portion extending downward from the body portion;

a battery pack attachment portion disposed at a lower part of the handle portion;

a hook disposed on a side surface of the battery pack attachment portion; and a screw to fix the hook, wherein the hook has a base portion to which a folded back portion is connected, an engagement portion connecting the folded back portion, and a screw hole through which the screw is inserted, wherein the base portion and the engagement portion extend in a vertical direction respectively, a first through-hole is formed in the base portion and a second through-hole is formed in the engagement portion.

* * * * *